US011134727B2

(12) United States Patent
Hearst

(10) Patent No.: US 11,134,727 B2
(45) Date of Patent: Oct. 5, 2021

(54) SCENTED MASK SYSTEM

(71) Applicant: Jennifer V. Hearst, Alpharetta, GA (US)

(72) Inventor: Jennifer V. Hearst, Alpharetta, GA (US)

( * ) Notice: Subject to any disclaimer, the term of this patent is extended or adjusted under 35 U.S.C. 154(b) by 0 days.

(21) Appl. No.: 13/938,906

(22) Filed: Jul. 10, 2013

(65) Prior Publication Data

US 2014/0053853 A1 Feb. 27, 2014

Related U.S. Application Data

(60) Provisional application No. 61/669,950, filed on Jul. 10, 2012.

(51) Int. Cl.
*A41D 13/11* (2006.01)

(52) U.S. Cl.
CPC ..... *A41D 13/1107* (2013.01); *A41D 13/11* (2013.01); *A41D 13/1161* (2013.01)

(58) Field of Classification Search
CPC . A41D 13/11–1192; A47J 31/06; A47J 31/18; A47J 41/0083; B65D 81/24; A61M 16/06–0694; A62B 7/00–14; A62B 18/00–025; A62B 25/00–005; A61L 2/00; A61L 2/16; A61L 2/20–238; A61L 9/01–037; A61L 9/04; A61L 9/12–127; A61L 9/00–127
USPC ..... 128/848, 861, 862, 859, 863, 857, 858; 422/306, 292, 5; 602/902; 190/20–39, 190/109
See application file for complete search history.

(56) References Cited

U.S. PATENT DOCUMENTS

| | | | | |
|---|---|---|---|---|
| 2,243,982 | A * | 6/1941 | Seeley | A61F 9/04 2/12 |
| 4,084,585 | A | 4/1978 | Venaleck | |
| 4,995,556 | A * | 2/1991 | Arnold, III | A61L 9/01 239/57 |
| 5,165,603 | A * | 11/1992 | Hahn | A45D 40/0068 239/55 |
| 5,243,708 | A | 9/1993 | Vanuch | |
| 5,682,607 | A | 11/1997 | Klein | |
| 5,706,800 | A | 1/1998 | Cronk et al. | |
| 5,727,544 | A * | 3/1998 | Miura | A41D 13/11 128/201.13 |
| 6,584,975 | B1 * | 7/2003 | Taylor | 128/206.11 |
| 6,793,881 | B2 * | 9/2004 | Himes | 422/5 |
| 7,032,751 | B2 * | 4/2006 | Bell et al. | 206/390 |
| 7,311,105 | B2 | 12/2007 | Plummer, Jr. et al. | |
| 7,861,317 | B2 | 1/2011 | Beliveau | |

(Continued)

FOREIGN PATENT DOCUMENTS

| | | | |
|---|---|---|---|
| JP | 408164207 | A | 6/1996 |
| JP | 2003334249 | A | 11/2003 |
| WO | 2004110541 | A | 12/2004 |

*Primary Examiner* — Michelle J Lee
(74) *Attorney, Agent, or Firm* — The Law Firm of Andrea Hence Evans, LLC

(57) ABSTRACT

The invention features a scented mask system to provide a pleasant smell in an unpleasant environment. The mask is a one-piece stretchable material with openings sized to fit aelliptical the user's ears. The mask becomes fragrant when nestled inside of a pod having an area sized to receive at least one fragrance component such as a fragrant discs or strips which cause the mask to become scented.

14 Claims, 5 Drawing Sheets

(56) References Cited

U.S. PATENT DOCUMENTS

| | | | | |
|---|---|---|---|---|
| 8,387,163 | B2 * | 3/2013 | Beliveau | A41D 13/11 2/9 |
| 2007/0181448 | A1 * | 8/2007 | Davis | A61L 9/012 206/209 |
| 2007/0272248 | A1 * | 11/2007 | Lin | A62B 18/025 128/206.28 |
| 2008/0223371 | A1 | 9/2008 | Guillory | |
| 2011/0239347 | A1 * | 10/2011 | Beliveau | 2/9 |
| 2012/0325843 | A1 * | 12/2012 | Tsuei | A41D 13/1115 221/303 |

* cited by examiner

SCENTED MASK SYSTEM

RELATED U.S. APPLICATION DATA

This application claims the benefit of provisional application No. 61/669,950, filed Jul. 10, 2012.

FIELD OF THE INVENTION

The present invention relates, in general, to a scented mask system having a disposable mask fitted on the nose, wherein the mask is nestled inside of a pod having a fragrance component which transfers the scent to the mask.

BACKGROUND OF THE INVENTION

Many people are susceptible to bad smells and foul odors due to the environment or poor hygiene of others. Morticians, researchers, and those around animal wastes, for example, are more sensitive and reactive to the scents around them. Pregnant women have a heightened sense of smell during pregnancy due to pregnancy hormones. The heightened sense of smell often leads to morning sickness. Being surrounded by unpleasant smells causes sickness and can often cause employees to be less productive because they are seeking a solution to avoid the foul odors. Opening windows or using spray or plug-in air fresheners are not effective.

SUMMARY OF THE INVENTION

The present invention provides a lightweight scented mask used to make trips to less fragrant places more bearable. The mask is nestled in a scented pod having a fragrance compartment that stores a fragrant component such as powders, discs or strips which transfers the scent to the mask.

An aspect of an embodiment of the invention provides a mask of a stretchable material that is effortless to fit and use.

A further aspect of an embodiment of the invention features a mask that covers the region around the nose of the user and features cutouts sized to receive the user's ears.

A further aspect of an embodiment of the invention features the mask being unitary and one piece.

A further aspect of an embodiment of the invention features a pod having an area sized to receive at least one fragrant component such as a scented disc.

A further aspect of an embodiment of the invention features the fragrance compartment area sized to receive the fragrant components having walls and a cover with openings that allow the fragrance to escape.

Additional aspects, objectives, features and advantages of the present invention will become apparent from the following description of the preferred embodiments with reference to the attached drawings.

BRIEF DESCRIPTION OF THE DRAWINGS

FIG. 6*ab* is an enlarged illustration of the indentions on the bottom half of the pod.

DETAILED DESCRIPTION OF THE INVENTION

Figure 1:
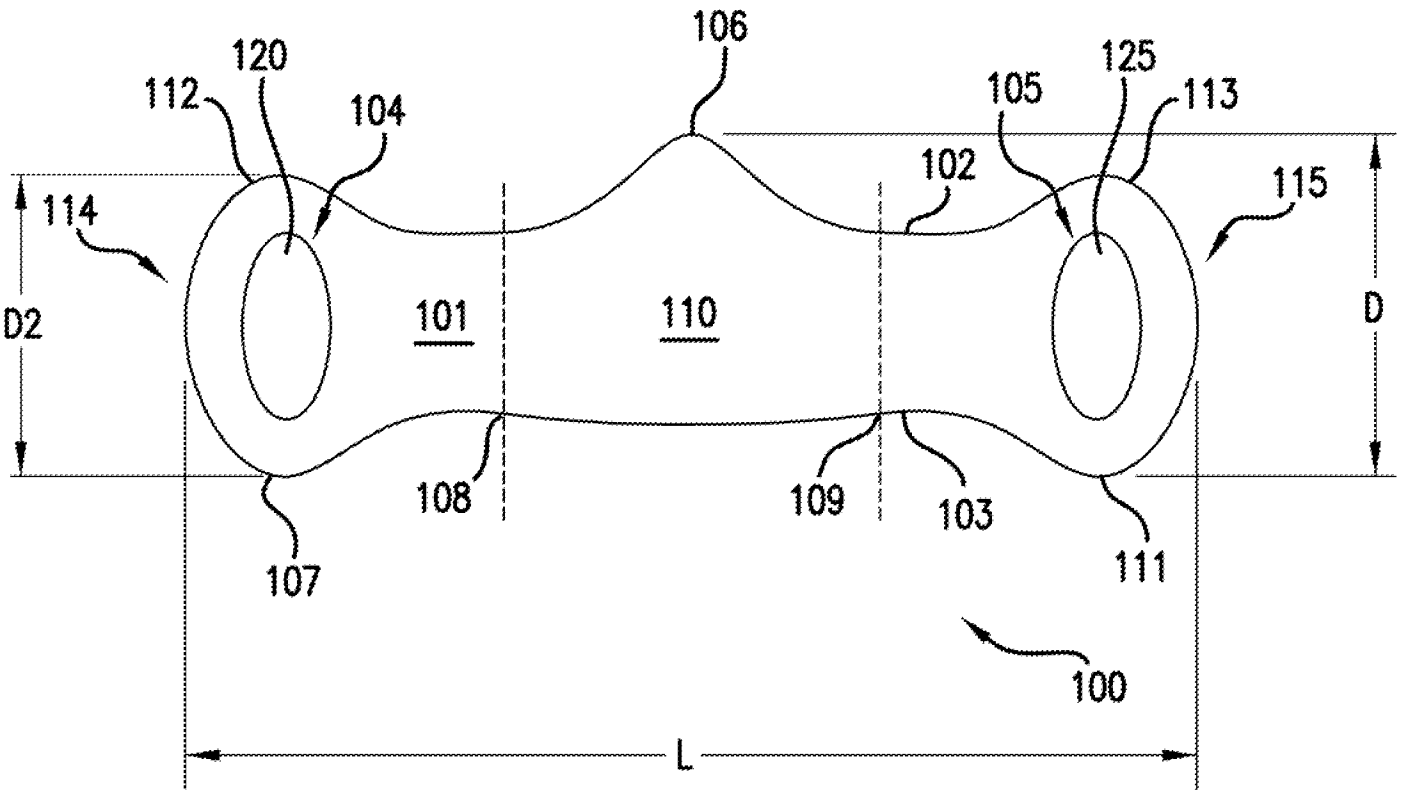
FIG. 1 is a perspective view of the mask of the present invention.

FIG. 1 is a perspective view of the mask 100 of the present invention. The scented mask system comprises a mask 100 and a pod 200. The mask is a unitary one-piece sheet of stretchable material 101 having a top edge 102, bottom edge 103 and a left end region 104 and a right end region 105. The mask is thin, lightweight, and breathable. The material is preferably spandex; however, a stretchable, absorbent material that can maintain integrity may be used. The scent from the pod 200 transfers to the mask 100 allowing the user to breathe a pleasant and soothing smell, when desired. The mask 100 will vary in color to match the user's complexion or they can feature designs or be transparent. The mask 100 is sized to be worn on the user's face to cover the user's nose so the user breathes the fragrance directly. The material 101 spans a distance D of about 3" between the top edge 102 and bottom edge 103. The central region 110 of the sheet is the middle area of the sheet 101 between the left region 104 and the right region 105 shown by dashed lines 108 and 109. The sheet is die cut such that the length L of the sheet is about 12 inches. Because the material is deformable, the length L of the sheet does not have to be the distance from the left and right ear of the user because the user can stretch the material towards the left and right ears of the user so that the mask can be connected to the user's ears, in use by aligning the cutouts with the ears. The middle area 110 of the top edge 102 forms a peak 106 which contacts an external ridge of the user's nose, when the mask is worn by the user. The top edge 102 slopes upwards from the left and right regions, 104, 105 towards the middle area 110 to form the peak 106. The peak 106 is in the shape of a hill and is the highest point along the top edge 102. The distance D2 between the top edge 102 and bottom edge 103 in the left and right regions 104, 105 is less than the distance D from the peak 106 along the top edge 102 to the bottom edge 103. The top edge 102 slopes downward along the left and right regions 104, 105 and then upwards to form the peak 106 in the middle area 106. The left and right regions contour the user's cheekbones when the mask is worn.

The bottom edge 103 sits slightly above a user's upper lip when worn. The left bottom edge area 107 slopes upwards towards the middle area 110 and then is somewhat straight and then slopes downwards towards the right bottom edge area 111. The left region 104 is the area to the left of the middle area 110 dashed line 108. The right region 105 is the area to the right of the middle area 110 dashed line 109. The bottom edge can be longer to cover the user's upper and lower lip so long as the nose of the user is covered when the mask is worn. The left top edge area 112 and the left bottom edge area 107 form a curved left end 114 on the mask. The right top edge area 113 and the right bottom edge area 111 form a curved right end 115. A first cutout 120 and a second cutout 125 are in the left end region 112 and the right end region 113. The cutouts 120, 125 are elliptical-shaped openings on the sheet 101 where the sheet material is removed from the mask to form the openings. In use, the user grasps the mask by ends 114 and 115 and positions the left and right ear through the cutouts 120, 125, respectively. The cutouts 120, 125 are integral with the sheet material and no additional straps or connecting mechanism are required to position or hold the mask in place nor are additional materials necessary to be attached to the mask. It is not necessary to expand or resize the cutouts as they are sized to receive the user's ear and no additional altering of the cutouts is required. The mask does not have to be turned or folded to use or see the cutouts.

Figure 10:
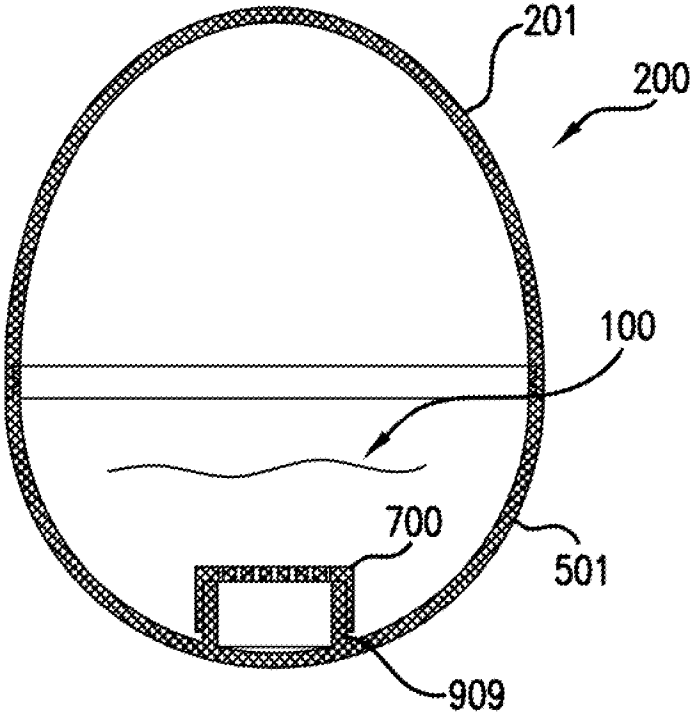
FIG. 10 is a view of the connected top and bottom halves of the pod along the cross section line.
Figure 9:
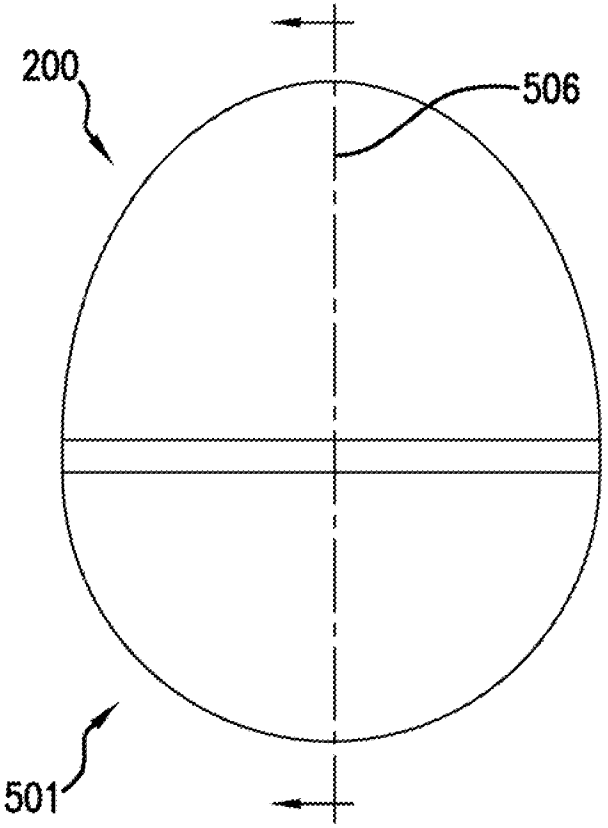
FIG. 9 is a perspective view of the connected top and bottom halves of the pod with a cross section line.

FIG. 9 is a perspective view of the connected top 201 and bottom halves 501 of the pod 200 with a vertical cross section line 506 dividing the bottom half 501 in half. FIG. 10 is a view of the connected top 201 and bottom halves 501 of the pod 200 along the cross section line 506. The top and bottom halves 201, 501 are semi-round around the sides but somewhat flat along the top half center point 203 or the bottom half center point 503 so the pod can sit freestanding in an upright position on either its top or bottom half. The sides of each pod side may be indented so that the user can easily grip and control the pod sides.

Figure 3:
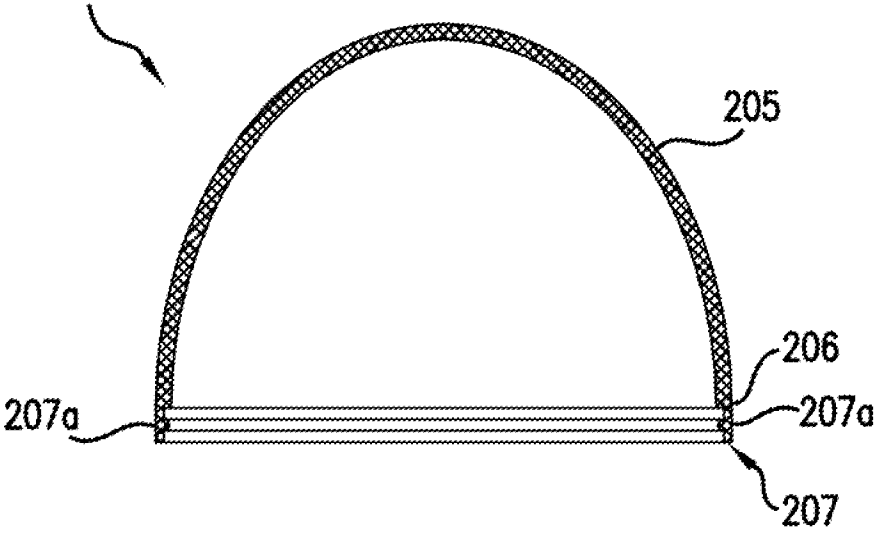
FIG. 3 is a view of the top half of the pod along the cross section line.
Figure 2:
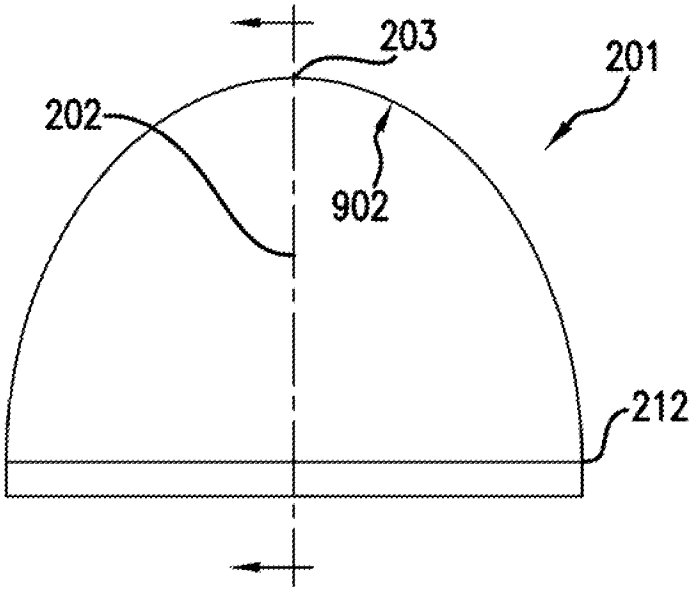
FIG. 2 is a perspective view of the top half of the pod showing a cross section line.
Figure 6A:
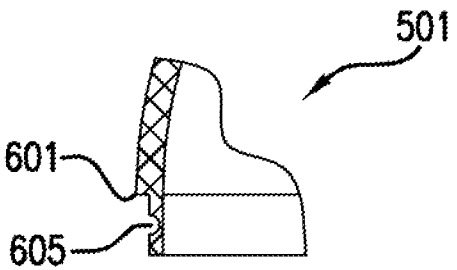
FIG. 6*a* is an illustration of the bottom half of the pod along the cross section line.
Figure 6A:
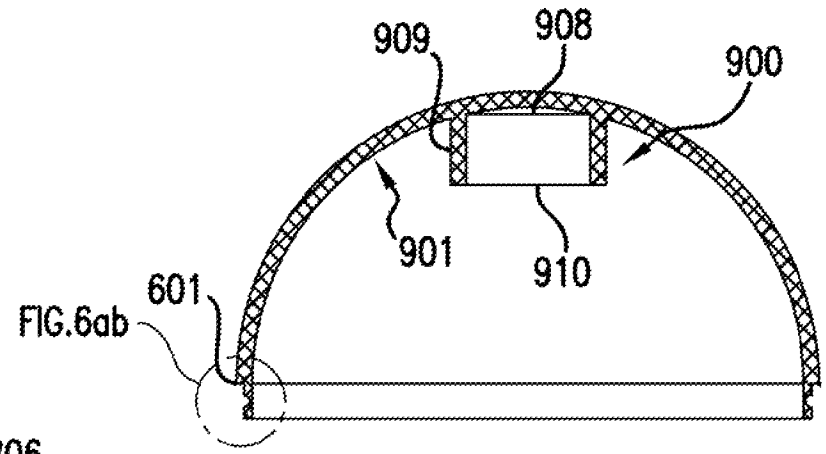

FIG. 2 is a perspective view of the top half 201 of the pod 200 showing a vertical cross section line 202. FIG. 3 is a view of the top half 201 of the pod 200 along the cross section line 202. The top half 201 of the pod 200 has an oval egged shape on a top area 205 extending from the edge 212. The bottom area 206 of the top half features ridges 207 around the edge of the top half. The ridges 207 will mate with the bottom area 806 of the bottom half 501.

Figure 5:
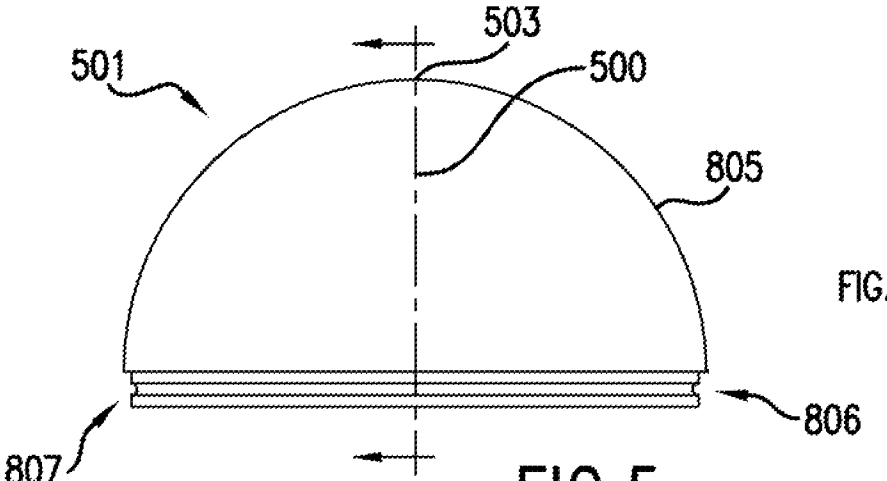
FIG. 5 is a perspective view of the bottom half of the pod showing a cross section line.

FIG. 5 is a perspective view of the bottom half 501 of the pod showing a cross section line 500 along the vertical axis dividing the bottom half in half. The bottom edges of each half meet in a closed position. The edges may screw into each other in a secure closed position whereby rotating the top side in an opposite direction from the bottom side, or vice versa, the halves will be secured and closed. The edges may also feature a seal which will remain intact until it is broken, when the sides are disengaged or the pod is in an open position. Alternately, the pod halves may be attached by an adhesive, Velcro® or snap inside of each other in a closed position.

The bottom half 501 of the pod 200 has an oval egged shape on the bottom area 805 extending from the bottom edge 806. The edge 806 features indentions 807 that mate with the ridges 207 of the top half 201 of the pod. The indentions 807 and ridges 207 extend fully around the circular edges of the top and bottom halves. FIG. **6*ab* is an enlarged illustration of the indentions 807 of the bottom half of the pod along the cross section line 500. The indention 807 is formed by a cutout of the bottom area 805 of the bottom half. The top portions 601 of the bottom edge 806 contact the bottom area 206 of the top half. The ridge 207 has a thickness or protrusion 207*a* that is sized to fit securely into the middle indention area 605. The bottom area 206 of the top half and bottom area 805 of the bottom half connect and are snapped and fitted inside the connected halves as shown in FIGS. 9 and 10**.

FIG. **6*a* is an illustration of the bottom half 501 of the pod 200 along the cross section line 500. The bottom half or the top half can feature a fragrance compartment 900** which will house a fragrant component such as a scented powder, scented strips, scented discs or the like. The fragrant components can be made from paper stickers, felt, cardboard or other similar materials that can retain a scent for long periods of time. The discs feature fragrances that are made from an essential oil or gentle fragrances. The scents should be soothing and pleasant smells such as mint, lavender or orange, for example. Alternatively, the scented discs may span the area along the edges of the top and bottom halves. A protective layer can be attached to the discs and to its respective pod side. When the pod halves are disengaged the protective layer is removed from the disc releasing the fragrance. Thus, the disc will avoid unnecessarily drying out and the fragrance will last longer. The inside of the pods may be lined with scented discs, strips or stickers that are fragranced with essential oil or some type of fragrance carrier.

For illustration and discussion purposes, the fragrance compartment 900 is shown in the bottom half 501. The fragrance compartment 900 is positioned along an inside base 901 of the bottom half 501 or the inside base 902 of top half 201. The fragrance compartment 900 has a circular base 908 that sits along the inside base 901 or 902. A wall 909 extends away from the circular base 908, wherein the walls 908 act to surround the fragrant components which will be housed in the compartment. The compartment has an opening 910 which receives the components such that the fragrance components are between the walls 909.

Figure 4:
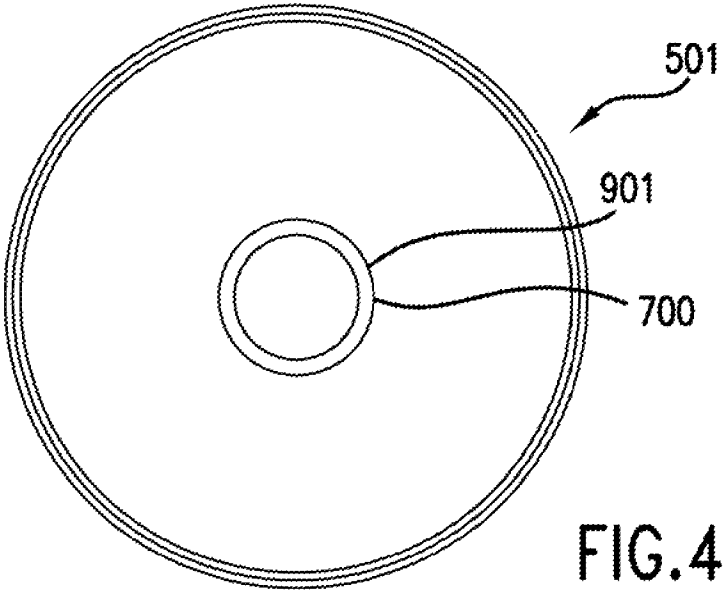
FIG. 4 is an inside view of the bottom half of the pod.
Figure 8:
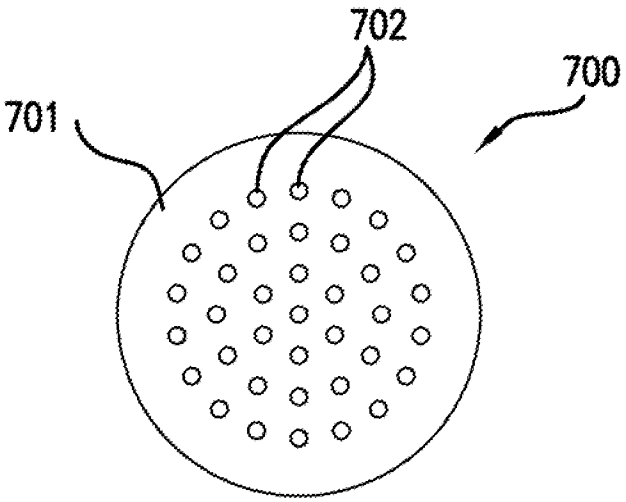
FIG. 8 is a top view of the fragrance compartment cap.
Figure 7:
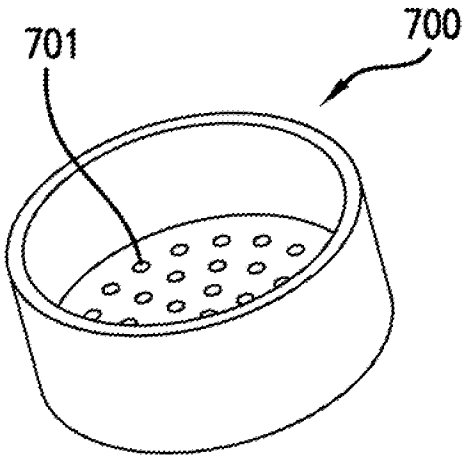
FIG. 7 is a perspective view of the fragrance compartment cap.

FIG. 4 is an inside view of the bottom half 501 of the pod 200. The fragrance compartment cap 700 fits over the opening 910 of the compartment 901 to further secure the fragrant components. FIG. 7 is a perspective view of the fragrance compartment cap 700. FIG. 8 is a top view of the fragrance compartment cap 700. The fragrance compartment cap 700 has a diameter slightly larger than the opening 910 of the compartment 901 so that the cap will press fit over the opening securely. Alternatively, the cap can be designed to screw onto the opening of the compartment. The top side 701 of the cap 700 features apertures 702 which release the scent of the components without the need for the component to physically contact the mask. The mask 100 is placed inside of the first or second half of the pod and the pod is closed, as discussed above. The sheet of stretchable material absorbs the scent of the fragrant components released through the cap apertures. When the scented mask is removed from the pod, the user's ears are placed through the cutouts and the user can breathe the pleasurable fragrance absorbed by the mask from the fragrant components in the pod.

The invention has been described in detail with particular reference to certain preferred embodiments thereof, but it will be understood that variations and modifications can be effected within the spirit and scope of the invention.

The invention claimed is:

1. A scented mask system comprising: one sheet of stretchable material having a top edge, bottom edge and a left end region and a right end region, wherein the bottom edge is below the top edge, left end region, and right end region, and the bottom edge is adapted to be positioned above a user's upper lip, wherein the bottom edge is characterized by an upward slope from the left end region contiguous with a straight portion in turn contiguous with a downward slope towards the right end region;

a first and second elliptical-shaped cutout in the left end region and right end region, wherein the first and second elliptical-shaped cutouts are configured to receive the user's left and right ear, respectively;

a substantially round egg shaped pod comprising a top half and a bottom half, each of the top and bottom halves comprising a circular opening and a base;

wherein one of the bottom half or the top half features a fragrance compartment having a compartment opening formed by a cylindrical wall, wherein the cylindrical wall extends from the base of the one of the bottom half or the top half in a direction of the mask and the circular opening of each of the top and bottom halves, wherein the cylindrical wall is centered with respect to the circular opening of the one of the bottom half or the top half, wherein the cylindrical wall of the fragrance compartment and an inside of the base of the one of the bottom half or the top half are a unitary one piece structure;

an integral peak, located at a middle area between the left and right end regions, wherein the peak is formed by upward sloping of the top edge from the left and right end regions towards the middle area on the one sheet; and a fragrance compartment cap having at least one aperture, wherein the fragrance compartment cap is sized to cover the compartment opening; wherein the sheet of stretchable material is supported by the pod.

2. The scented mask system of claim 1, further comprising fragrant components wherein the fragrant components are supported by the fragrance compartment.

3. The scented mask system of claim 2, wherein the sheet of stretchable material absorbs a scent of the fragrant components released through the at least one aperture.

4. The scented mask system of claim 2, wherein the fragrant components are housed within the cylindrical wall of the fragrance compartment.

5. The scented mask system of claim 1, wherein the top half and the bottom half connect with each other.

6. The scented mask system of claim 5, wherein ridges around the circular opening of the top half are configured to mate with indentations around the circular opening of the bottom half.

7. The scented mask system of claim 1, wherein the middle area of the top edge forms the peak which is adapted to contact an external ridge of the user's nose.

8. A scented mask system comprising: a unitary sheet of stretchable material having a top edge, bottom edge and a left end region and a right end region, wherein the bottom edge is below the top edge, left end region, and right end region, and is sized such that the bottom edge is adapted to be positioned above a user's upper lip, wherein a middle area of the top edge forms a peak configured to contact an external ridge of the user's nose, wherein the bottom edge is characterized by an upward slope from the left end region contiguous with a straight portion in turn contiguous with a downward slope towards the right end region;

a first and second cutout in the left end region and right end region, wherein the first and second cutouts are configured to receive the user's left and right ear, respectively;

a substantially round shaped pod comprising a rounded top half and a rounded bottom half; each of the top and bottom halves comprising a circular opening and a base; wherein one of the bottom half or the top half features a fragrance compartment having a compartment opening formed by a cylindrical wall, wherein the cylindrical wall extends from the base of the one of the bottom half or the top half in a direction of the mask and the circular opening of each of the top and bottom halves, wherein the cylindrical wall is centered with respect to the circular opening of the one of the bottom half or the top half, wherein the cylindrical wall of the fragrance compartment and an inside of the base of the one of the bottom half or the top half are a unitary one piece structure;

the peak being located at the middle area between the left and right end regions, wherein the peak is formed by upward sloping of the top edge from the left and right end regions towards the middle area; and a fragrance component in the fragrance compartment, wherein the sheet of stretchable material is positioned in the pod and absorbs a fragrance of the fragrance component.

9. The scented mask system of claim 8, wherein the fragrance component is in an inside area of the one of the top or bottom half of the pod.

10. The scented mask system of claim 8, wherein the cutouts are configured to receive the user's left and right ears after the scented mask is removed from the pod.

11. The scented mask system of claim 8, wherein ridges around the circular opening of the top half are configured to mate with indentations around the circular opening of the bottom half.

12. A scented mask system comprising: a unitary sheet of stretchable material having a top edge, bottom edge and a left end region and a right end region, wherein the bottom edge is below the top edge, left end region, and right end region, and the bottom edge is adapted to be positioned above a user's upper lip, wherein the bottom edge is characterized by an upward slope from the left end region contiguous with a straight portion in turn contiguous with a downward slope towards the right end region;

a first and second cutout in the left end region and right end region, wherein the first and second cutouts are configured to receive the user's left and right ear, respectively;

a round egg shaped pod comprising a round top half and a round bottom half, each of the top and bottom halves comprising a circular opening and a base; wherein one of the bottom half or the top half features a fragrance compartment having a compartment opening formed by a cylindrical wall, wherein the cylindrical wall extends from the base of the one of the bottom half or the top half in a direction of the mask and the circular opening of each of the top and bottom halves, wherein the cylindrical wall is centered with respect to the circular opening of the one of the bottom half or the top half, wherein the cylindrical wall of the fragrance compartment and an inside of the base of the one of the bottom half or the top half are a unitary one piece structure;

a peak, located at a middle area between the left and right end regions along the unitary sheet, wherein the peak is formed by upward sloping of the top edge from the left and right end regions towards the middle area; and a fragrance component in the fragrance compartment, wherein the fragrance component is positioned within the cylindrical wall, wherein the sheet of stretchable material is positioned in the pod and absorbs a fragrance of the fragrance component.

13. The scented mask system of claim 12, further comprising a fragrance compartment cap having at least one aperture, wherein the fragrance compartment cap is sized to cover the fragrance compartment.

14. The scented mask system of claim 12, wherein ridges around the circular opening of the top half are configured to mate with indentations around the circular opening of the bottom half.

* * * * *